US005563570A

United States Patent [19]

Lee

[11] Patent Number: 5,563,570

[45] Date of Patent: Oct. 8, 1996

[54] RESISTOR DEVICE FOR CONTROLLING A ROTATIONAL SPEED OF A MOTOR

[75] Inventor: Woo Y. Lee, Seoul, Rep. of Korea

[73] Assignee: Dong A Electric Parts Co., Ltd., Kyungki-do, Rep. of Korea

[21] Appl. No.: 270,178

[22] Filed: Jul. 1, 1994

[51] Int. Cl.[6] ..... H01C 1/084

[52] U.S. Cl. ..... 338/50; 338/51; 338/95; 361/24; 361/25; 310/68 C

[58] Field of Search ..... 338/24, 50–51, 338/91, 95, 92; 310/68 C, 68 D; 361/23, 24, 25, 26, 30

[56] References Cited

U.S. PATENT DOCUMENTS

| | | | |
|---|---|---|---|
| 3,541,489 | 11/1970 | Person | 338/51 |
| 4,034,265 | 7/1977 | DuRocher et al. | 338/114 X |
| 4,931,626 | 6/1990 | Shikama et al. | 338/22 R |
| 4,935,717 | 6/1990 | Osawa et al. | 338/51 |
| 4,992,687 | 2/1991 | Nel | 310/68 D |
| 5,000,662 | 3/1991 | Yamamoto et al. | 338/308 X |

*Primary Examiner*—Teresa J. Walberg
*Assistant Examiner*—Raphael Valencia
*Attorney, Agent, or Firm*—Morgan & Finnegan, L.L.P.

[57] ABSTRACT

The present invention relates to a resistor device for controlling a rotational speed of a motor which has no directional property and provides a convenient setting. A resistance unit is positioned which includes at least four connecting points connected to connecting terminals at an upper predetermined position of a housing, and a heat sink having at least four supporting legs is provided to form passing paths open in all directions on the housing. Also, the resistance unit is adhered on the heat sink through an insulating layer, a second heat sink corresponding to the first heat sink is adhered on the resistance unit through the insulating layer, and short-circuit means having a soldered portion to be fused at a predetermined temperature upon an overloading of the motor is provided between the resistance unit and any one terminal. Accordingly, the present invention enables the resistor device to be freely positioned without a directional property and prevents heat by the short-circuit means from disturbing the resistor device.

8 Claims, 2 Drawing Sheets

RESISTOR DEVICE FOR CONTROLLING A ROTATIONAL SPEED OF A MOTOR

BACKGROUND OF THE INVENTION

The present invention relates to a resistor device for controlling a rotational speed of a motor, and more particularly, to a resistor device for controlling a rotational speed of a motor which improves the attaching position of a resistance unit of the resistor device.

Typically, the rotational speed of a motor driving a cooling fan may be gradually controlled by a resistor device. In response to the control of the motor, however, heat is generated from a resistor circuit of the resistor device thereby decreasing the speed control function of the motor and potentially damaging the resistor device when the heat generated is severe.

Accordingly, the resistor device may be cooled by mounting the resistor circuit upon a wide heat sink means of rectangular form and positioning the resistor device in front of an outlet exhausting cooling air produced by the fan. However, it is necessary to position the resistor device in front of the outlet such that the heat sink does not disturb the flow of cooling air from the outlet to other neighboring parts. To avoid restricting the flow of cooling air from the outlet, there are a limited number of ways to position the resistor device.

A conventional resistor device also contains a short circuit means for preventing burning damage to the motor by cutting off the current applied to the motor side when an overload due to a mechanical defect of the motor occurs. Accordingly, a problem exists in preventing the short circuit means from executing as a result of thermal radiation from the resistor circuit. And, there is a further problem that a by-product, such as residual produced upon fusing of the short circuit means, becomes adhered to the resistor circuit.

SUMMARY OF THE INVENTION

Therefore, to solve the above-described problems, an object of the present invention is to provide a resistor device for controlling a rotational speed of a motor such that the heat sink means attached to the resistor circuit are horizontally positioned, and that a short-circuit means of the resistor circuit is positioned a predetermined distance form the resistor circuit, thereby improving the attaching workability of the resistor device and simultaneously providing a smooth thermal radiation of the resistor circuit.

To accomplish the above object of the present invention, there is provided a resistor device for controlling a rotational speed of a motor comprising a housing having a widely formed fixing plate at an upper portion and uprightedly fixed with connecting terminals at the interior, a resistor circuit positioned on a fixed plate of the housing for controlling current flowing to the motor side connected by terminals to thereby control a rotational speed of the motor into multiple steps, a resistance unit fixed to a predetermined location of the top portion of the housing for forming the resistor circuit and having at least four connecting points connected to the connecting terminals to a predetermined portion, a first heat sink means having a predetermined width for adhering to one side of the resistance unit and horizontally located on the housing, the heat sink means having at least four supporting legs forming a passing path open to all directions between the housing, and a second heat means integrally adhered to an opposite side surface of the resistance unit.

DETAILED DESCRIPTION OF THE PREFERRED EMBODIMENT

Hereinafter, a preferred embodiment of a resistor device for controlling a rotational speed of a motor in accordance with the present invention will be described with reference to the accompanying drawings.

Figure 1:
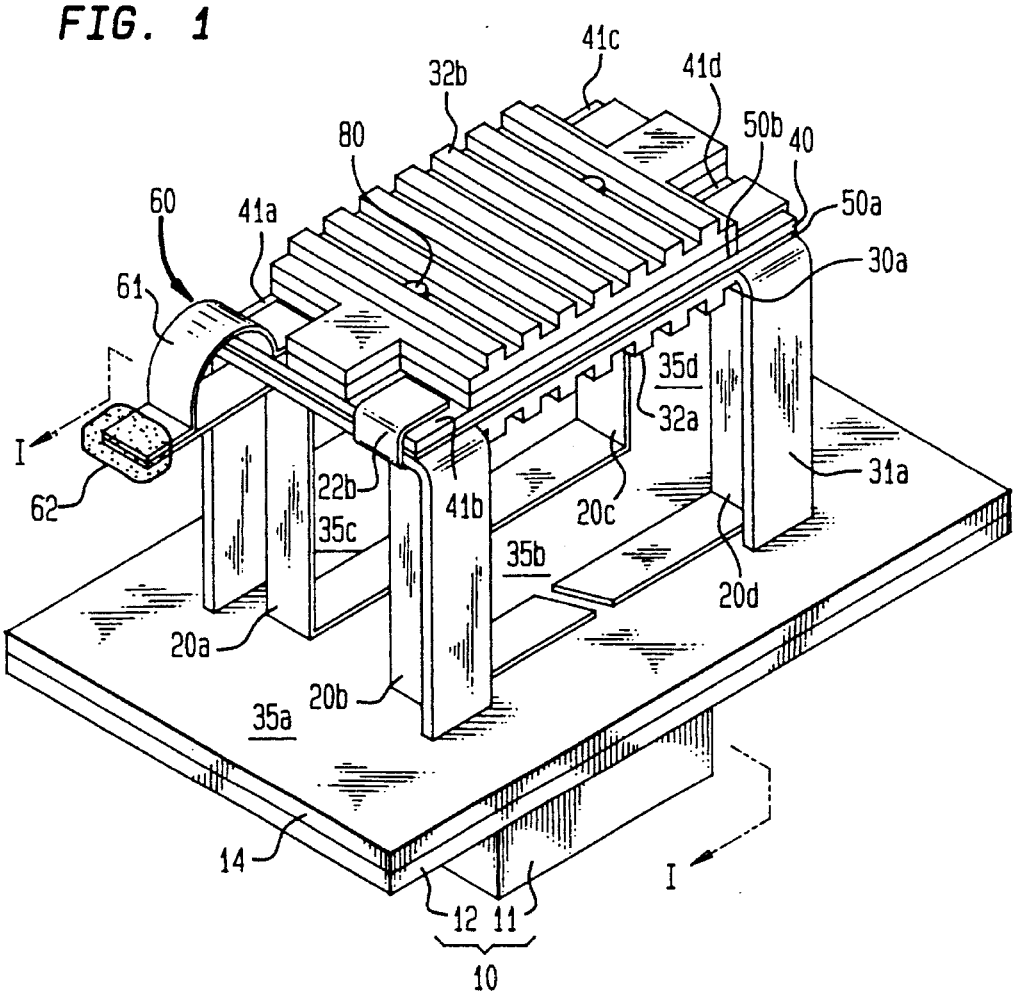
FIG. 1 is a perspective view of a resistor device for controlling a rotational speed of a motor in accordance with the present invention.
Figure 2:
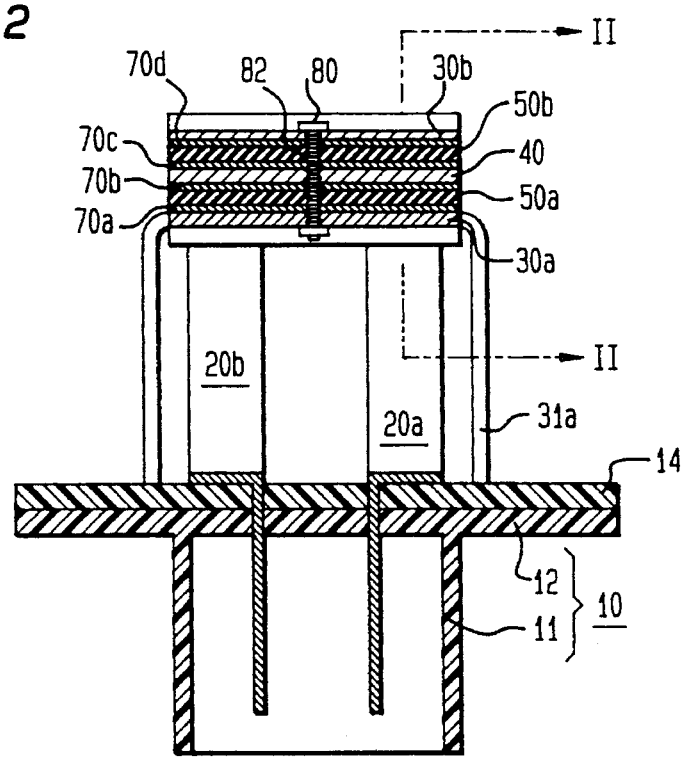
FIG. 2 is an enlarged cross sectional view taken along line I—I of FIG. 1.

FIG. 1 shows a perspective view of a resistor device for controlling a rotational speed of a motor in accordance with the present invention. As shown in the drawing, the resistor device of the present invention includes a housing 10 composed of a socket 11 of tube shape made narrower at its bottom and a widely formed fixed plate means 12 integrally connected to the upper portion of the socket 11. A base plate 14 corresponding to a width of the fixed plate means 12 is integrally attached to the fixed plate 12 of the housing 10. First to fourth connecting terminals 20*a*–20*d* are provided to the housing 10. Referring to FIG. 2, one end of each of the first to fourth connecting terminals 20*a*–20*d* passes through the fixed plate 12 and the base 14 to be uprightly fixed from the top of housing 10, while the other end of connecting terminals 20*a*–20*d* extend within the interior of socket 11. The connecting terminals 20*a*–20*d* are used for connecting a motor (not shown) to a resistance unit described hereinafter.

A first heat sink 30*a*, of approximately rectangular form and having a predetermined area, is fixed above the housing 10. The first heat sink 30*a* includes at least four downwardly extending supporting legs 31*a* integrally bent at each corner. The first heat sink 30*a* is horizontally disposed above the base plate 14 and supported by supporting legs 31*a* so that cooling air directed from any side of the device may pass through openings 35*a*–35*d* formed between the housing 10 and the first heat sink 30*a*.

A plurality of thermal radiating fins 32*a* are provided on one side of first heat sink 30*a* for more rapidly radiating heat generated by the resistor circuit, which will be more fully described hereafter. The first heat sink 30*a* and the supporting legs 31*a* are integrally molded from an aluminum material having a good thermal radiative property.

Figure 4:
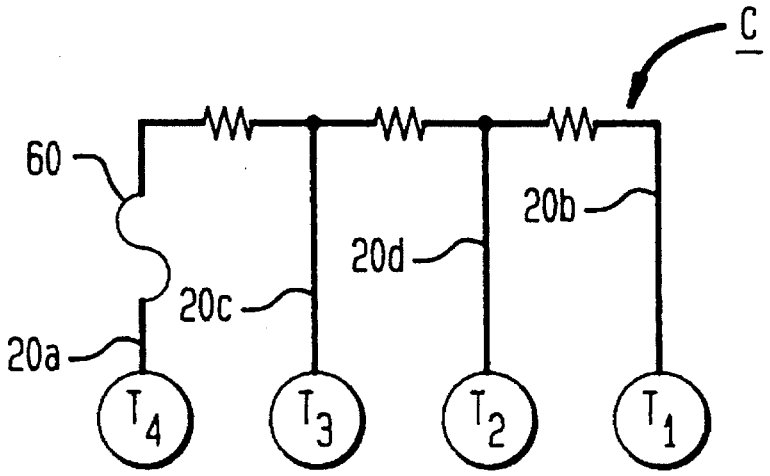
FIG. 4 is a diagram of a resistor circuit applied to a resistor device for controlling a rotational speed of a motor in accordance with the present invention.

A resistance unit 40 forming the resistor circuit described in FIG. 4 is positioned on the first heat sink 30*a*. The first and second insulators 50*a*, 50*b* are located are integrally connected to the top and bottom surfaces of the resistance unit 40 and first insulator 50*a* is adhered to first heat sink 30*a*.

The resistance unit includes at least four connecting points 41*a*–41*d* for connecting with the first to fourth connecting terminals 20*a*–20*d* at each corner of the resistance unit 40. The first to fourth connecting points 41*a* –41*d* are one portion of the resistor circuit as hereinafter described.

One side of the second insulator 50*b* is integrally attached to the resistance unit 40 by the connecting units 41*a* –41*d*.

The other side of second insulator 50*b* is integrally connected to the one side of second heat sink 30*b* such that neither second insulator 50*b* nor second heat sink 30*b* cover connecting points 41*a*–41*d*. The second heat sink 30*b* and the second insulator 50*b* have cut-out forms corresponding to the position of connecting points 41*a*–41*d* such that neither second insulator 50*b* nor second heat sink 30*b* cover connecting points 41*a*–412*d*. The second heat sink 30*b* is also formed of the same material as the first heat sink 30*a*. The second heat sink 30*b* has a plurality of second thermal radiating fins 32*b* corresponding to the first thermal radiating fins 32*a* formed on the side opposite that connected to second insulator 50*b*.

Figure 3:
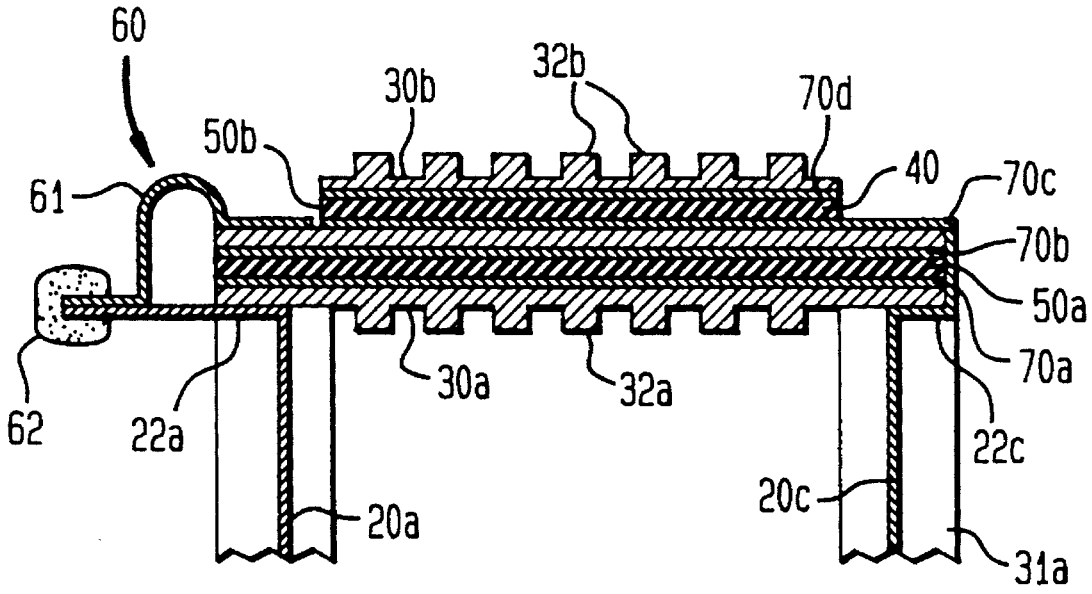
FIG. 3 is a lateral cross sectional view taken along line II—II of FIG. 2.

Referring FIGS. 1–3, at least two fixing screws 80 are also used to couple first heat sink 30*a* and first insulators 50*a* to one side of resistor unit 40 and to couple second heat sink 30*b* and second insulator 50*b* to the other side of resistor unit 40.

The second to fourth connecting terminals 20*b*–20*d* are directly connected to the second to fourth connecting points 41*b*–41*d*, while the first connecting terminal 20*a* is connected to the first connecting point 41*a* through the short circuit means 60 for protecting burning damage of a motor (not shown).

And, the first to fourth connecting terminals 20*a*–20*d* include supporting steps 22*a*, 22*b* for supporting heat sink 30*a*. The supporting steps 22*a*, 22*b* are formed by bending top portions of the terminals. The heat sink 30*a* is more firmly supported by supporting legs 31*a* and supporting steps 22*a*, 22*b*.

The short-circuit means 60 is made by a fuse spring 61 having an elastic force. Any one end of the fuse spring 61 is connected to the first connecting point 41*a* or the resistance unit 40 and the other end of fuse spring 61 is connected to first connecting terminal 20*a*. The fuse spring 61 includes a soldered portion 62 for short-circuiting the power supply applied to the motor side (not shown) through the resistance unit 40 at the connection of fuse spring 61 to first connecting terminal 20*a*. The soldered portion 62 is set so as to be fused at a predetermined temperature when overheating based upon overload of a motor due to a mechanical defect occurs. Damage to the motor by overheating is prevented by the above-mentioned fusing of the soldered portion 62. The fuse spring 61 is of a slowly bent form so that it can rapidly spring from the first connecting terminal 20*a* upon fusing of the soldered portion 62.

FIG. 2 is an enlarged cross sectional view taken along a line I—I of FIG. 1, and FIG. 3 is an enlarged cross sectional view taken along a line II—II of FIG. 2. As shown in FIG. 2, the end of the connecting terminals 20*a*, 20*b* upwardly extending through fixed plate 12 of the housing 10 and the base plate 14 is in contact with first heat sink 30*a*. The other end of connecting terminals 20*a*, 20*b* downwardly extending from fixed plate 12 into the socket 11 are connected to the motor side.

Referring to FIG. 3, the terminals 20*a*, 20*c* are bent to form supporting steps 22*a*, 22*c* which firmly support the first heat sink 30*a*. The resistance unit 40, first and second heat sinks 30*a*, 30*b*, and first and second insulators 50*a*, 50*b* are firmly attached by applying an adhesive material therebetween, as is illustrated by the first to fourth adhering layers 70*a*–70*d* illustrated in FIG. 3. For further tightening, fixing screw 80 is inserted into the fixing hole 82 passing through the second heat sink 30*b*, second insulator 50*b*, resistance unit 40, first insulator 50*a*, and fist heat sink 30*a*.

FIG. 4 is a diagram of the resistor circuit applied to the resistor device in accordance with the present invention. The resistor circuit C is formed to the resistance unit 40 described in FIGS. 1–3. The resistor circuit C includes a predetermined number of resister elements, and to each of which the first to fourth connecting terminals 20*a*–20*d* are connected. The short-circuit means 60 is set to the higher step being easily overloaded. Resistance values of the resistor elements are set to be from a low stage (first step) to a high stage (fourth step). Accordingly, when any one step of the first to fourth connecting terminals 20*a*–20*d* connected to the motor side is selected, a desired rotational speed of the motor can be obtained. In the event of overheating caused by an overload due to a mechanical defect during driving of the motor, the short-circuit means 60 is short-circuited at a predetermined temperature thereby cutting off the current applied to the motor side through the resistor C. As such, damage to the motor is minimized or avoided. The resistance elements forming the resistor C may be modified to a voluntary number other than that shown in the drawing, and it will easily be understood that the step number for controlling a rotational speed of the motor becomes various.

Thus, the present invention horizontally positions the resistance unit 40 having a resistor circuit C and heat sinks 30*a*, 30*b* away from the housing, thereby permitting the flow of air between the housing 10 and first heat sink 30*a* from any direction. Accordingly, the present invention provides greater flexibility in positioning the resistor device around the cooling air outlet of the cooling fan in order to control the driving motor of the cooling fan. Moreover, the present invention makes it more convenient to position the resistor device.

Also, the short-circuit means 60 connected to the resistor device is independently formed at a predetermined distance form the resistor circuit C. Accordingly, the present invention provides a thermal radiation that is easily executed at usual time, and prevent by-product from being smeared to the resistor circuit C upon fusing of the soldered portion 62 due to an overload of the motor.

I claim:

1. A resistor device for controlling a rotational speed of a motor comprising:

(a) a housing having an upper portion and an interior;

(b) a fixing plate attached to the upper portion of said housing;

(c) a plurality of connecting terminals attached to said fixing plate, each having a first end downwardly extending from said fixing plate into the interior of said housing, and each having a second end upwardly extending from said fixing plate;

(d) a resistance unit having opposing first and second surfaces and connected to the upper portion of said housing, said resistance unit forming a resistor circuit for controlling the current flow to said motor and having at least four connecting points connected to the second end of said connecting terminals at a predetermined portion;

(e) first heat sink means having a predetermined width, said first heat sink means attached to the first surface of said resistance unit and horizontally located on said housing, said first heat sink means having at least four supporting legs forming a passing path open in all directions between said housing and said first heat sink means; and (f) second heat sink means integrally connected to the second surface of said resistor unit.

2. A resistor device for controlling a rotational speed of a motor as defined in claim 1, further comprising a short-circuit means electrically connected between said resistance unit and at least one of said connecting terminals.

3. A resistor device for controlling a rotational speed of a motor as defined in claim 2, wherein said short-circuit means comprises a soldered portion having a characteristic of being fused at a predetermined temperature upon an overload of said motor.

4. A resistor device for controlling a rotational speed of a motor as defined in claim 1, further comprising insulators which are positioned between and integrally connected to said resistance unit and said first and second heat sinks.

5. A resistor device for controlling a rotational speed of a motor as defined in claim 2, wherein said short-circuit means comprises a band shaped fuse spring having an elastic force, said band shaped fuse spring electrically connecting said resistance unit to any one of the connecting terminals.

6. A resistor device for controlling a rotational speed of a motor as defined in claim 1, wherein supporting steps are formed to the connecting terminals for supporting either the first or second heat sink.

7. A resistor device for controlling a rotational speed of a motor as defined in claim 1, further comprising adhering means for integrally connecting said first and second heat sinks to said resistance unit.

8. A resistor device for controlling a rotational speed of a motor as defined in claim 4, further comprising adhering means for integrally connecting said insulators to the first and second heat sinks and to said resistance unit.

* * * * *